US009805709B2

(12) United States Patent
Liu et al.

(10) Patent No.: US 9,805,709 B2
(45) Date of Patent: Oct. 31, 2017

(54) HOWLING SUPPRESSION METHOD AND DEVICE APPLIED TO AN ANR EARPHONE

(71) Applicant: Goertek Inc, Weifang (CN)

(72) Inventors: Song Liu, Weifang (CN); Shasha Lou, Weifang (CN); Fupo Wang, Weifang (CN)

(73) Assignee: Goertek Inc., Weifang (CN)

( * ) Notice: Subject to any disclaimer, the term of this patent is extended or adjusted under 35 U.S.C. 154(b) by 38 days.

(21) Appl. No.: 14/901,555

(22) PCT Filed: Jul. 4, 2014

(86) PCT No.: PCT/CN2014/081662

§ 371 (c)(1),
(2) Date: Dec. 28, 2015

(87) PCT Pub. No.: WO2015/007167

PCT Pub. Date: Jan. 22, 2015

(65) Prior Publication Data

US 2016/0372102 A1 Dec. 22, 2016

(30) Foreign Application Priority Data

Jul. 16, 2013 (CN) ..... 2013 1 0298438

(51) Int. Cl.
*G10K 11/178* (2006.01)
*H04R 3/00* (2006.01)
(Continued)

(52) U.S. Cl.
CPC ..... *G10K 11/178* (2013.01); *H04R 1/1016* (2013.01); *H04R 3/00* (2013.01);
(Continued)

(58) Field of Classification Search
None
See application file for complete search history.

(56) References Cited

U.S. PATENT DOCUMENTS

2008/0021703 A1* 1/2008 Kawamura ..... H04R 3/005 704/226
2010/0092016 A1* 4/2010 Iwano ..... H04R 25/407 381/313

(Continued)

*Primary Examiner* — Paul Huber
(74) *Attorney, Agent, or Firm* — Leydig, Voit & Mayer, Ltd.

(57) ABSTRACT

The present invention discloses a howling suppression method and device applied to an ANR earphone. The method comprises: collecting signals by using a first microphone and a second microphone; wherein the first microphone is arranged in a position outside an auditory meatus when said ANR earphone is worn, and the second microphone is arranged in a position inside the auditory meatus when the ANR earphone is worn; according to a relation between signals collected by the first microphone and the second microphone, judging whether the current state of said ANR earphone is a state unable to produce a howling or a state able to produce a howling; and when the current state of said ANR earphone is a state able to produce a howling, starting processing for preventing howling production. The technical scheme can achieve that the ANR earphone does not produce a howling all the time.

10 Claims, 5 Drawing Sheets

(51) Int. Cl.
*H04R 1/10* (2006.01)
*H04R 3/02* (2006.01)

(52) U.S. Cl.
CPC ..... *H04R 3/02* (2013.01); *G10K 2210/1081* (2013.01); *G10K 2210/3026* (2013.01); *G10K 2210/3027* (2013.01); *G10K 2210/3055* (2013.01); *G10K 2210/506* (2013.01); *G10K 2210/511* (2013.01); *H04R 2460/01* (2013.01)

(56) References Cited

U.S. PATENT DOCUMENTS

2012/0114141 A1* 5/2012 Tanaka ..... H04R 3/02
381/94.1
2014/0086425 A1* 3/2014 Jensen ..... G10K 11/1784
381/71.11

* cited by examiner

HOWLING SUPPRESSION METHOD AND DEVICE APPLIED TO AN ANR EARPHONE

CROSS-REFERENCE TO RELATED APPLICATIONS

This application is a national phase entry of pending International Application No. PCT/CN2014/081662, filed Jul. 4, 2014 and titled "Squeal Suppression Method and Device for Active Noise Removal (Anr) Earphone," which claims priority to and the benefit of Chinese Patent Application No.: 201310298438.8, filed Jul. 16, 2013 and titled "Howling Inhibition Method and Device for ANR (Active Noise Reduction) Earphones." The contents of the above-identified Applications are relied upon and incorporated herein by reference in their entirety.

TECHNICAL FIELD

The invention relates to the field of acoustic processing technology, particularly to a howling suppression method and device applied to an Active Noise Reduction (ANR) earphone.

BACKGROUND ART

Present earphones generally reduce the influence of environmental noise on human ear using Active Noise Reduction (ANR) technology. ANR technology usually comprises Feed Forward ANR circuit (FF ANR) or Feed Back ANR circuit (FB ANR), or comprises both.

Implementation of FF ANR usually need place a Reference Microphone (REF MIC) outside an earphone (the earphone is positioned outside the auditory meatus when worn) for perceiving environmental noise. The REF MIC signal is played via a Speaker (SPK) after being processed by earphone inner circuit and the signal played offsets the environmental noise that is transmitted to the external auditory meatus to eliminate the influence of environmental noise on human ear. Implementation of FB ANR usually need place an Error Microphone (ERR MIC) inside an earphone (the earphone is positioned inside the auditory meatus when worn) for perceiving environmental noise that penetrates the earphone. The ERR MIC signal is played via the Speaker after being processed by earphone inner circuit and the signal played offsets the environmental noise that is transmitted to the external auditory meatus to eliminate the environmental noise.

FIG. 1 is a structure diagram of an ANR earphone. FIG. 1 shows a REF MIC 101 placed outside the earphone, an ERR MIC 102 placed inside the earphone and a Speaker 103.

According to the technology adopted by ANR earphones, ANR earphones can be classified into Feed Forward Active Noise Reduction (FF ANR) earphone, Feed Back Active Noise Reduction (FB ANR) earphone and Hybrid Active Noise Reduction (Hybrid ANR) earphone.

FIG. 2A is a functional block diagram of a FF ANR earphone. FIG. 2B is a functional block diagram of a FB ANR earphone. FIG. 2C is a functional block diagram of a Hybrid ANR earphone. In FIG. 2A and FIG. 2C, FF ANR module performs corresponding processing on signals collected by a REF MIC and displays them via a Speaker (SPK); in FIGS. 2A, 2B and 2C, OUTPUT denotes earphone outputting signal, such as musical signal that is played, voice from the other side of the phone, and the like. Environmental noise signal is picked up by a REF MIC and an ERR MIC and is played via the SPK after being processed by the FF ANR module and the FB ANR module. The voice signal played by the SPK is again picked up by the REF MIC and the ERR MIC, and again played via the SPK after being processed by the FF ANR module and the FB ANR module respectively. Positive feedback will be formed when some condition is satisfied, and thus a howling is produced.

FIG. 3 is a modeling diagram of a howling. Open-loop response is defined as $T_O(z, n)=G(z)F(z, n)$. Wherein z denotes frequency point and n denotes time. The condition of producing howling is, at some frequency $f_{Osc}$, satisfying $$<T_O(2\pi f_{Osc}, n)=k2\pi, k\in N$$

$$=T_O(2\pi f_{Osc}, n)|>1$$

then the feedback system is unstable, creating vibration, and thus the howling is produced. When aforesaid condition is satisfied, amplitude of signal of which frequency is $f_{Osc}$ increases exponentially in the cyclic process of $G(z)\rightarrow F(z, n)\rightarrow G(z)$, and the amplitude tends to be infinite after repeatedly circulating in ideal state. However, for the ANR earphone, it usually increases till reaching the maximal amplitude value owning to the limitation of total voltage of the circuit or MIC amplitude.

FIG. 4 is a modeling diagram of a howling of a FF ANR earphone. As is shown in FIG. 4, the forward direction path transfer function of the system is $TF_{REF\sim SPK}$; the feedback path transfer function is $TF_{SPK\sim REF}$; When howling condition is satisfied, a howling is produced.

FIG. 5 is a modeling diagram of a howling of a FB ANR earphone. As is shown in FIG. 5, the forward direction path transfer function of system is $TF_{ERR\sim SPK}$; the feedback path transfer function is $TF_{SPK\sim ERR}$; When howling condition is satisfied, a howling is produced.

For the Hybrid ANR earphone, when feed forward loop or feedback loop satisfies the howling condition, or feed forward and feedback loop simultaneously satisfy the howling condition, or functions of feed forward and feedback loop combine together to satisfy the howling condition, then a howling is produced.

After the howling is produced, power of the Speaker playing reaches the maximum; sound pressure level at MIC reaches the highest; and electric current on circuit reaches the maximum, thus it is likely to damage the Speaker and MIC and power consumption will increase prominently, and the circuit is likely to be burnt out. After the howling, the Speaker will emit sound wave of high sound pressure level at the frequency point of howling, which is likely to cause discomfort to users.

Function of the howling suppression is suppressing howling to avoid damaging components and circuit or causing discomfort to users. The howling suppression generally comprises two parts: howling detection and howling processing. Howling detection is to detect whether or not a howling is produced at present or whether or not a howling is likely to be produced at present; howling processing is to break the positive feedback loop that causes howling production, so that a howling is not produced. The howling processing method of the ANR earphone comprises amending ANR parameters or shutting down ANR circuit, etc.

The feature of a howling is that the howling is usually produced at some frequency point, while environmental noise, voice, music and the like are usually broadband signals. Therefore, howling suppression method usually adopted by prior arts performs detection by using the feature of frequency-domain of a signal of a howling, i.e. monofrequency signal detection method. Detecting a monofrequency signal is considered as a howling is produced, and then howling processing should be performed to suppress howling. Specific procedure is first converting the digital signal that is converted by A/D to frequency-domain, and dividing the frequency-domain into several different frequency bands and detecting which frequency band has howling via the method of peak-to-average ratio of the frequency-domain, and then performing frequency suppression on the frequency band with a howling. This practice can be used for Feed Forward, Feed Back and Hybrid ANR earphones. However, the weakness of the practice is that the howling can only be detected after the howling is produced, that is, there is a short period of howling time. If the practice is applied to ANR earphones, a transitory howling might appear. That is, users can hear a short howling, and the MIC and SPK might be damaged since the howling is produced. Thus the best method is to avoid the production of a howling.

SUMMARY OF THE INVENTION

The present invention provides a howling suppression method and device applied to an ANR earphone, to prevent ANR earphone from producing a howling.

In order to achieve the above objective, the technical scheme of the present invention is achieved as follows:

The present invention discloses a howling suppression method applied to an Active Noise Reduction (ANR) earphone, and the method comprises:

collecting signals by using a first microphone and a second microphone; wherein the first microphone is arranged in a position outside an auditory meatus when said ANR earphone is worn, and the second microphone is arranged in a position inside the auditory meatus when the ANR earphone is worn;

according to a relation between signals collected by the first microphone and the second microphone, judging whether the current state of said ANR earphone is a state unable to produce a howling or a state able to produce a howling;

when the current state of said ANR earphone is a state able to produce a howling, starting processing for preventing howling production.

The present invention also discloses a howling suppression device applied to an Active Noise Reduction (ANR) earphone, and the device comprises:

a first microphone, which is arranged in a position outside an auditory meatus when said ANR earphone is worn;

a second microphone, which is arranged in a position inside the auditory meatus when said ANR earphone is worn;

a state judger, according to a relation between signals collected by the first microphone and the second microphone, judging whether the current state of said ANR earphone is a state unable to produce a howling or a state able to produce a howling;

a howling processor, when the current state of said ANR earphone outputted by said state judger is a state able to produce a howling, starting processing for preventing howling production.

The technical scheme of the present invention, using the relation between signals collected by the first microphone which is arranged in a position outside an auditory meatus when the ANR earphone is worn and the second microphone which is arranged in a position inside the auditory meatus when the ANR earphone is worn, can judge whether or not the ANR earphone is in a state able to produce a howling and can perform howling processing when judging that the ANR earphone is in a state able to produce a howling, so that howling production can be effectively prevented. The technical scheme of the present invention can achieve that the ANR earphone does not produce a howling all the time, and thus can avoid damaging device and reduce users' discomfort.

EMBODIMENTS OF THE INVENTION

Different from aforesaid method of detecting a howling by using the frequency-domain feature of a signal usually adopted by prior arts, in the present patent application the state of the ANR earphone can be divided into state able to produce a howling (Howling) and state unable to produce a howling (noHowling). If the state of an earphone at present can be distinguished, then whether or not the earphone is able to produce a howling at present can be known, that is, it is needed to distinguish that the ANR earphone is in a state of being able to produce a howling or in a state of being unable to produce a howling. If it is in the state of being able to produce a howling, directly perform the howling processing. If it is in the state of being unable to produce a howling, do not perform processing. The earphone may not immediately produce a howling after the earphone is in the state able to produce a howling, for howling production need to satisfy the condition of producing a howling. But in the present application, the howling processing is performed immediately if the earphone being in the state able to produce a howling is detected. That is, if the current state of the earphone is a state able to produce a howling, perform processing without exception as the howling is produced regardless of whether or not the condition of producing howling is satisfied. Therefore, the technical scheme of the patent application performs processing without the need to wait until the howling is produced, and thus can achieve that the ANR earphone does not produce a howling all the time.

To make the purpose, technical scheme and advantages of the invention clearer, the embodiments of the invention will be described in further detail with reference to the drawings.

Figure 1:
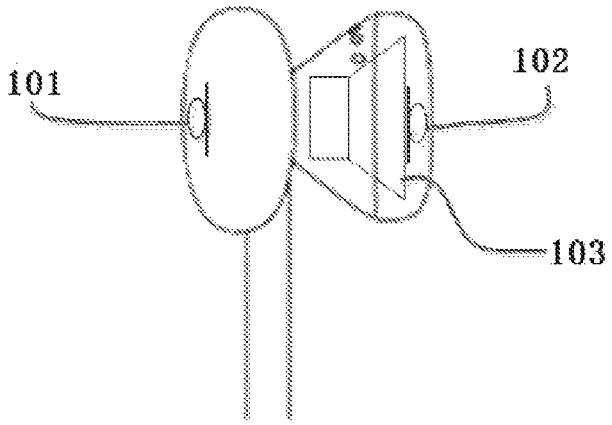
FIG. 1 is a structural diagram of an ANR earphone.
Figure 2A:
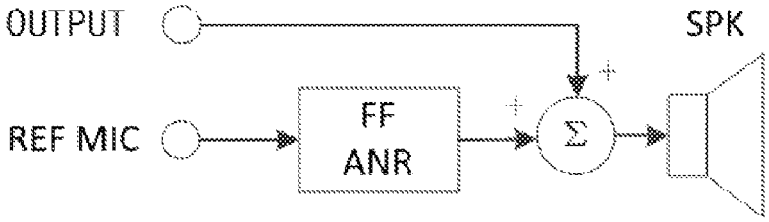
FIG. 2A is a functional block diagram of a FF ANR earphone.
Figure 2B:
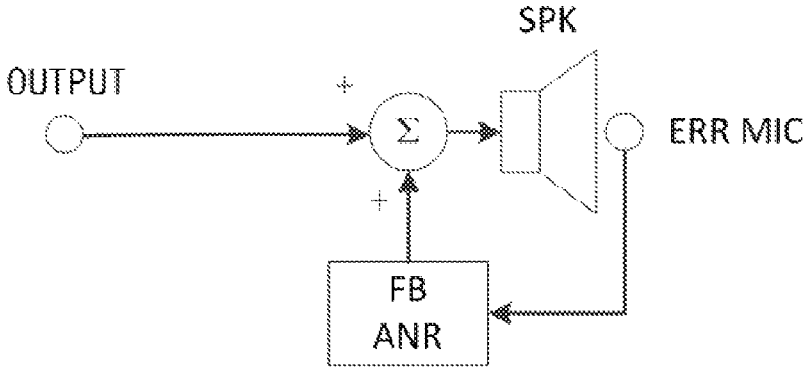
FIG. 2B is a functional block diagram of a FB ANR earphone.
Figure 2C:
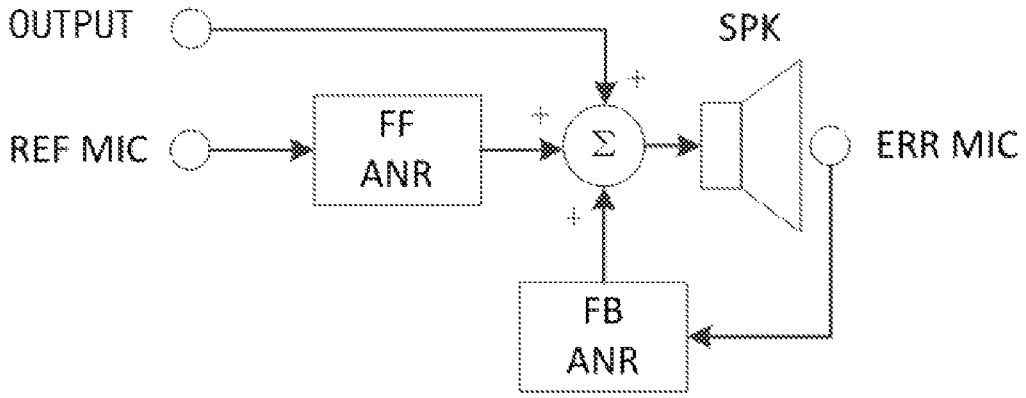
FIG. 2C is a functional block diagram of a Hybrid ANR earphone.
Figure 3:
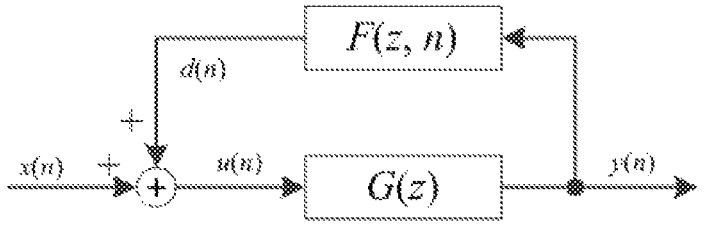
FIG. 3 is a modeling diagram of a howling.
Figure 4:
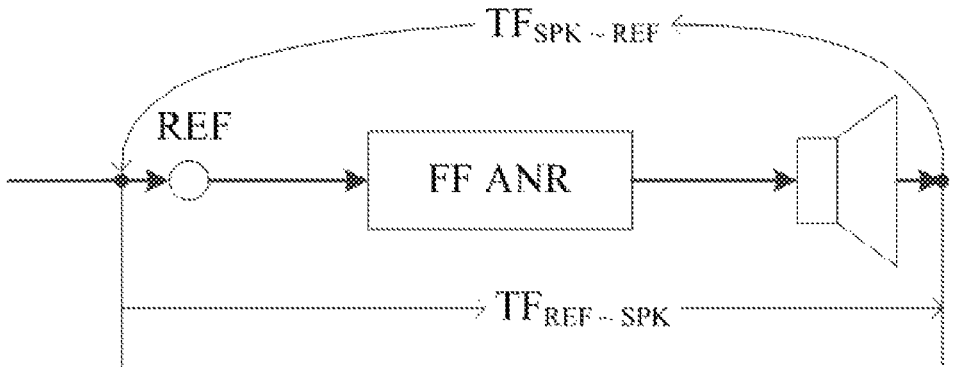
FIG. 4 is a modeling diagram of a howling of a FF ANR earphone.
Figure 5:
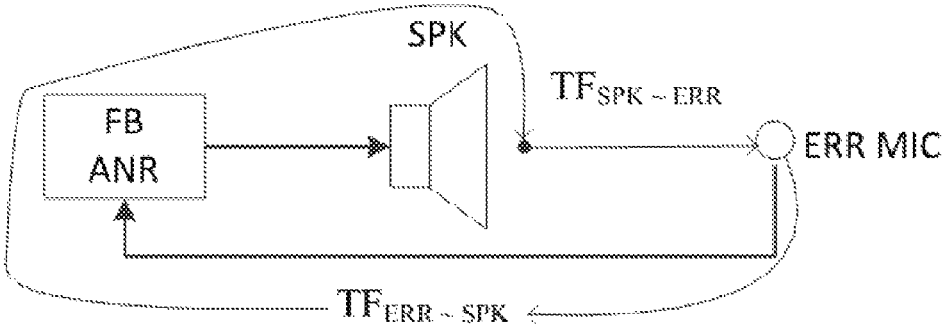
FIG. 5 is a modeling diagram of a howling of a FB ANR earphone.
Figure 6:
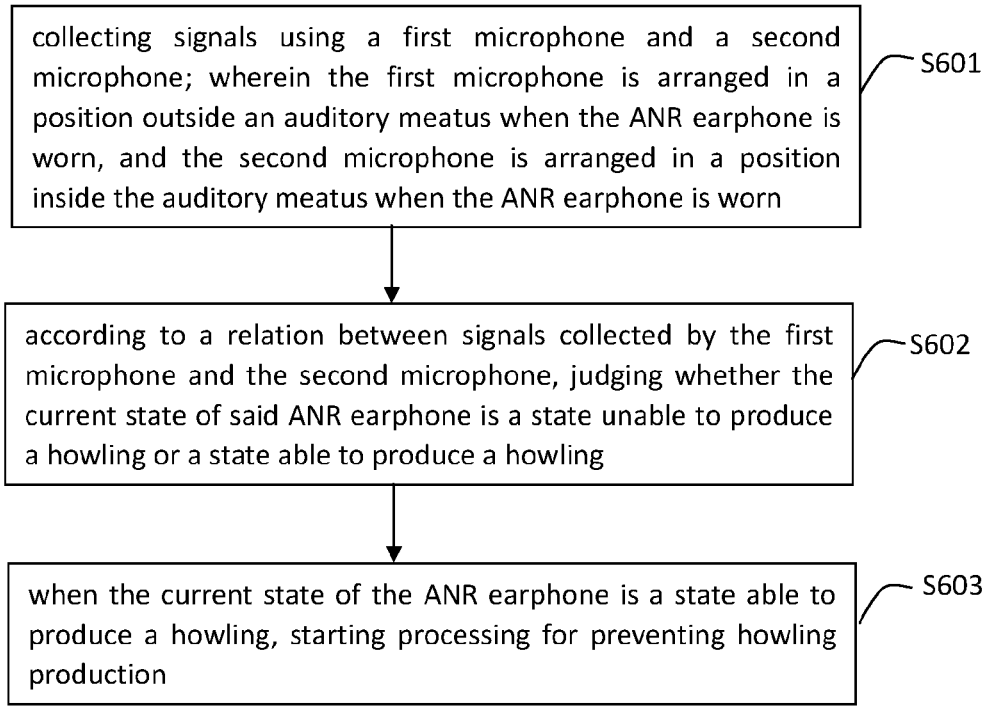
FIG. 6 is a flow chart showing a howling suppression method applied to an Active Noise Reduction (ANR) earphone of an embodiment of the invention.

FIG. 6 is a flow chart showing a howling suppression method applied to an Active Noise Reduction (ANR) earphone of an embodiment of the invention. As is shown in FIG. 6, the method comprises:

Step S601, collecting signals by using a first microphone and a second microphone; wherein the first microphone is arranged in a position outside an auditory meatus when said ANR earphone is worn, and the second microphone is arranged in a position inside the auditory meatus when said ANR earphone is worn.

In an embodiment of the invention, when the ANR earphone is a Feed Forward ANR earphone, the first microphone can be a Reference Microphone (REF MIC) demanded to realize the Feed Forward ANR. When the ANR earphone is a Feed Back ANR earphone, the second microphone can be an Error Microphone (ERR MIC) demanded to realize the Feed Back ANR. When the ANR earphone is a Hybrid ANR earphone, the first microphone can be a Reference Microphone (REF MIC) demanded to realize the Feed Forward ANR, and the second microphone can be an Error Microphone (ERR MIC) demanded to realize the Feed Back ANR.

Of course, the first microphone is not necessarily a REF MIC. It can also be a specialized microphone. The second microphone is not necessarily an ERR MIC. It can also be a specialized microphone. However, the cost will increase.

Step S602, according to a relation between signals collected by the first microphone and the second microphone, judging whether the current state of said ANR earphone is a state unable to produce a howling or a state able to produce a howling.

In a state unable to produce a howling and in a state able to produce a howling of the ANR earphone, the relation between signals collected by the first microphone and the second microphone will have certain difference. In the present invention, based on this difference the ANR earphone's state of being unable to produce a howling and the state of being able to produce a howling of can be distinguished.

Step S603, when the current state of said ANR earphone is a state able to produce a howling, starting processing to prevent howling production.

In the step, the specific technology which can be adopted to perform processing to prevent howling production comprises amending ANR parameters to break the condition of producing howling or directly shutting down the ANR circuit, etc.

The method shown in FIG. 6 can judge whether or not the ANR earphone is in a state able to produce a howling and can perform howling processing when judging that the ANR earphone is in a state able to produce a howling, and thus can prevent howling production when the ANR earphone is in a state able to produce a howling. The method can perform howling suppression processing before a howling is produced instead of waiting until the howling has been produced.

As is mentioned before, in Step S602 the ANR earphone's state of being unable to produce a howling and the state of being able to produce a howling can be distinguished according to a relation between signals collected by the first microphone and the second microphone. Specifically, calculating the transfer function from the first microphone to the second microphone according to the signals collected by the first microphone and the second microphone; judging whether the state of the ANR earphone is a state unable to produce a howling or a state able to produce a howling according to time-domain characteristics of the transfer function from the first microphone to the second microphone; or, judging whether the state of the ANR earphone is a state unable to produce a howling or a state able to produce a howling according to frequency-domain characteristics of the transfer function from the first microphone to the second microphone.

This is because, when the ANR earphone is in a state of being unable to produce a howling, the signal picked up by the two microphones is characterized in that: the environmental noise always first reaches the first microphone and then reaches the second microphone, thus it can be judged by causality of the transfer function between the first microphone and the second microphone; the environmental noise will be blocked by earphone cover and auricle before being picked up by the second microphone, which is equivalent to passing through a filter, and the high frequency part of the filter decays more than the low frequency part. When the ANR earphone is in a state of being able to produce a howling, the signal picked up by the two microphones is characterized in that: sequence of the environmental noise reaching the first microphone and the second microphone is not fixed, and sound wave has no obvious obstacle between the first microphone and the second microphone, thus there is no obvious filtering effect.

The environmental noise first reaches the first microphone and then reaches the second microphone and is blocked by earphone cover and auricle before being picked up by the second microphone, which is equivalent to passing through a filter. As can be known from the condition of producing howling, a howling can be produced only when positive feedback is created. In the state the signal amplitude is decayed and has filtering effect, thus the condition of producing howling is not satisfied and the howling will not be produced. The sequence of the environmental noise reaching the first microphone and the second microphone is not fixed, and sound wave has no obvious obstacle between the first microphone and the second microphone, thus there is no obvious filtering effect. As can be known from the condition of producing howling, the state is easy to satisfy the condition of producing howling, and hence will produce a howling.

It will be described in detail by taking Hybrid ANR earphone as an example below. In the embodiment, the first microphone is the REF MIC of the Hybrid ANR earphone, and the second microphone is the ERR MIC of the Hybrid ANR earphone. In the state that the earphone is normal and unable to produce a howling, the environmental noise always first reaches the REF MIC and then reaches the ERR MIC, thus it can be judged by causality of the transfer function between the REF MIC and the ERR MIC.

Figure 7:
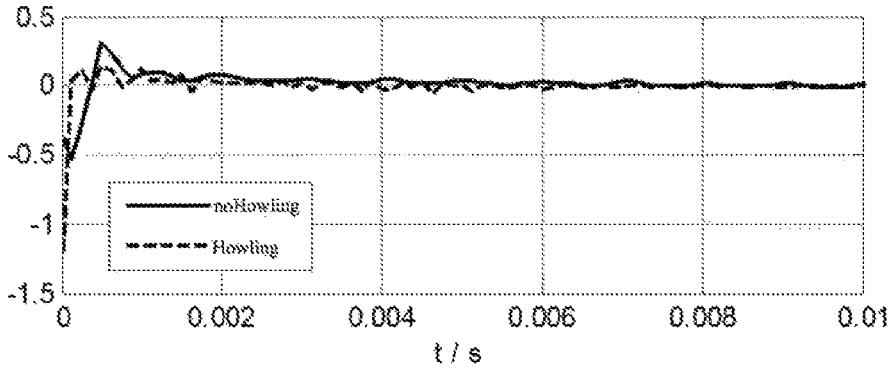
FIG. 7 is a comparison diagram showing an actual measurement result of a time-domain transfer function of a REF MIC to an ERR MIC of embodiments of the invention.

FIG. 7 is a comparison diagram showing an actual measurement result of time-domain transfer function from a REF MIC to an ERR MIC of embodiments of the invention. Seeing FIG. 7, the dotted line represents the time-domain transfer function from the REF MIC to ERR MIC in the state of being able to produce a howling (Howling), and the full line represents the time-domain transfer function from the REF MIC to ERR MIC in the state of being unable to produce a howling (noHowling). The maximum value point of the time-domain transfer function denotes the group delay of the sound wave. As can be seen in FIG. 7, the group delay in Howling state is 0, and the group delay in noHowling state is a positive value which is greater than 0. That is, the Howling state and noHowling state can be distinguished through characteristics of time delay of the transfer function from REF MIC to ERR MIC.

Figure 8:
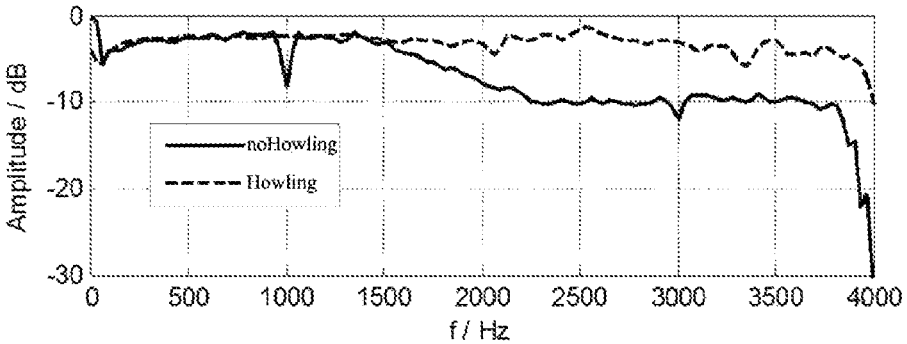
FIG. 8 is a comparison diagram showing an actual measurement result of a frequency-domain transfer function of a REF MIC to an ERR MIC of embodiments of the invention.

FIG. 8 is a comparison diagram showing an actual measurement result of frequency-domain transfer function from a REF MIC to an ERR MIC of embodiments of the invention. Seeing FIG. 8, the dotted line represents the frequency-domain transfer function from the REF MIC to ERR MIC in the state of being able to produce howling (Howling), and the full line represents the frequency-domain transfer function from the REF MIC to ERR MIC in the state of being unable to produce howling (noHowling). As can be seen in FIG. 8, the amplitude-frequency characteristic of the transfer function in Howling state is similar to an all-pass filter, and the amplitude-frequency characteristic of the transfer function in noHowling state is similar to a low-pass filter. That is, the amplitude-frequency characteristic of the transfer function from REF MIC to ERR MIC can also distinguish the noHowling state and the Howling state.

As can be seen, in the embodiment of the invention, after calculating the transfer function from the REF MIC to the ERR MIC, the ANR earphone's state of being able to produce howling can be judged by the time-domain characteristic of the transfer function, and also the ANR earphone's state of being unable to produce howling can be judged by the frequency-domain characteristic of the transfer function.

In an embodiment of the invention, according to the time-domain characteristic of the transfer function from the first microphone to the second microphone, judging the ANR earphone's state of being unable to produce howling specifically can be: making the time-domain judgment statistic as the ratio of quadratic sum of the first M orders to quadratic sum of the first N orders of the time-domain transfer function from the first microphone to the second microphone; N is a natural number, and N is the length of the time-domain transfer function; M is a natural number smaller than N; if the time-domain judgment statistic is smaller than judgment threshold, judging as the state unable to produce a howling; if the time-domain judgment statistic is larger than judgment threshold, judging as the state able to produce a howling. Wherein, the judgment threshold varies with the structural change of the earphone and is obtained by statistics. A specific compute mode of the method will not be explained here for the time being to avoid repetition, and please see the follow-up description corresponding to FIG. 10.

In another embodiment of the invention, according to the frequency-domain characteristic of the transfer function from the first microphone to the second microphone, judging whether the state of the ANR earphone is a state unable to produce a howling or a state able to produce a howling specifically can be: making the frequency-domain judgment statistic as the ratio of modular quadratic sum of the first M orders to modular quadratic sum of the first M+1 to N/2 orders of the frequency-domain transfer function from the first microphone to the second microphone; N is a natural number, and N is the length of the frequency-domain transfer function; M is a natural number smaller than N/2; if the frequency-domain judgment statistic is smaller than judgment threshold, judging as the state able to produce a howling; if the frequency-domain judgment statistic is larger than judgment threshold, judging as the state unable to produce a howling. Wherein, the judgment threshold varies with the structural change of the earphone and is obtained by statistics. A specific compute mode of the method will not be explained here for the time being to avoid repetition, and please see the follow-up description corresponding to FIG. 10.

Figure 9:
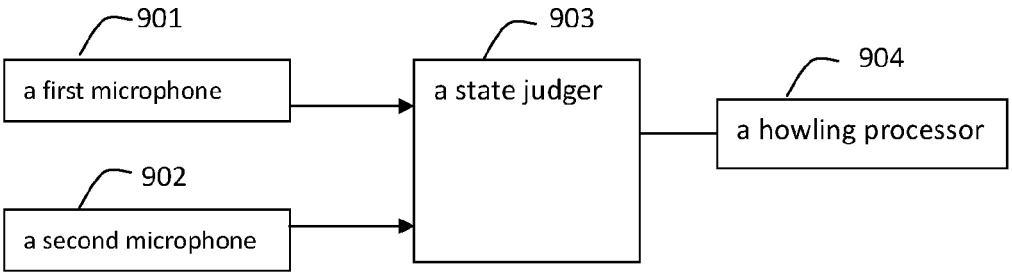
FIG. 9 is a structure diagram of a howling suppression device applied to an Active Noise Reduction (ANR) earphone of embodiments of the invention.

FIG. 9 is a structure diagram of a howling suppression device applied to an Active Noise Reduction (ANR) earphone of embodiments of the invention. As is shown in FIG. 9, the device comprises:

a first microphone 901, which is arranged in a position outside an auditory meatus when the ANR earphone is worn;

a second microphone 902, which is arranged in a position inside the auditory meatus when the ANR earphone is worn;

a state judger 903, according to a relation between signals collected by the first microphone 901 and the second microphone 902, judging whether the current state of the ANR earphone is a state unable to produce a howling or a state able to produce a howling;

a howling processor 904, when the current state of the ANR earphone outputted by the state judger 903 is a state able to produce a howling, starting processing to prevent howling production.

In an embodiment of the invention, when the ANR earphone is a Feed Forward ANR earphone, the first microphone 901 can be a Reference Microphone (REF MIC) demanded to realize the Feed Forward ANR; or, when the ANR earphone is a Feed Back ANR earphone, the second microphone 902 can be an Error Microphone (ERR MIC) demanded to realize the Feed Back ANR; or, when the ANR earphone is a Hybrid ANR earphone, the first microphone 901 can be a Reference Microphone (REF MIC) demanded to realize the Feed Forward ANR, and the second microphone 902 can be an Error Microphone (ERR MIC) demanded to realize the Feed Back ANR.

In an embodiment of the invention, the state judger 903 is for calculating the transfer function from the first microphone 901 to the second microphone 902 according to the signals collected by the first microphone 901 and the second microphone 902; and judging whether the state of the ANR earphone is a state unable to produce a howling or a state able to produce a howling according to the time-domain characteristics of the transfer function from the first microphone 901 to the second microphone 902, or judging whether the state of the ANR earphone is a state unable to produce a howling or a state able to produce a howling according to the frequency-domain characteristics of the transfer function from the first microphone 901 to the second microphone 902.

The device shown in FIG. 9 can judge whether or not the ANR earphone is in a state able to produce a howling and can perform howling processing when judging that the ANR earphone is in a state able to produce a howling, and thus can prevent howling production when the ANR earphone is in a state able to produce a howling.

Figure 10:
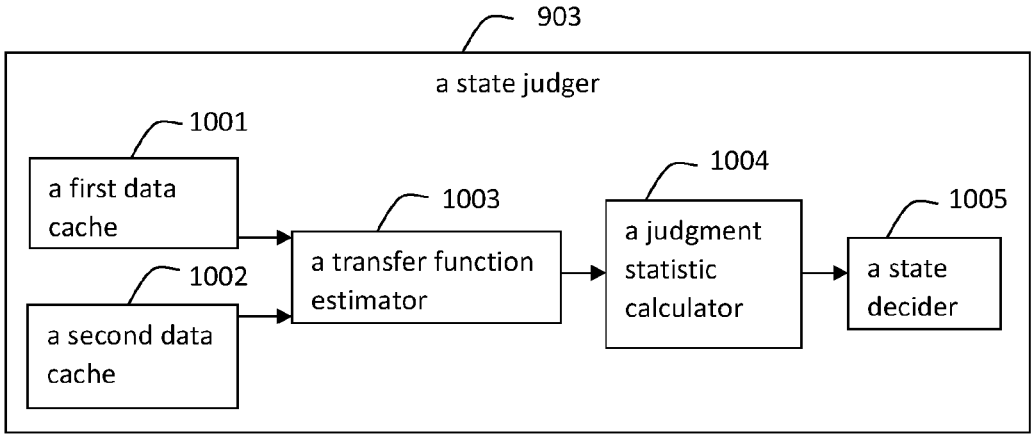
FIG. 10 is a structure diagram of a state judger 903 of an embodiment of the invention.

FIG. 10 is a structure diagram of a state judger 903 of an embodiment of the invention. As is shown in FIG. 10, the state judger 903 comprises:

a first data cache 1001, for caching digital signals collected by a first microphone 901;

a second data cache 1002, for caching digital signals collected by a second microphone 902;

a transfer function estimator 1003, for calculating the time-domain transfer function from the first microphone 901 to the second microphone 902 according to the data in the first data cache 1001 and the second data cache 1002;

a judgment statistic calculator 1004, for obtaining the time-domain judgment statistic according to the ratio of quadratic sum of the first M orders to quadratic sum of the first N orders of the time-domain transfer function from the first microphone to the second microphone; wherein N is a natural number and is the length of the time-domain transfer function; M is a natural number smaller than N;

and, a state decider 1005, for judging as the state unable to produce a howling when the time-domain judgment statistic is smaller than judgment threshold; and judging as the state able to produce a howling when the time-domain judgment statistic is larger than judgment threshold, wherein the judgment threshold varies with the structural change of the earphone and is obtained by statistics.

Still taking the Hybrid ANR earphone as an example, the first microphone 901 is the REF MIC of the Hybrid ANR earphone, and the second microphone 902 is the ERR MIC of the Hybrid ANR earphone. First the transfer function from the REF MIC to the ERR MIC is calculated. The digital signal $x_{Ref}[n]$ of the REF MIC and the digital signal $x_{Err}[n]$ of the ERR MIC enter into the first data cache 1001 and the second data cache 1002 respectively, forming data frames $\tilde{x}_{Ref}[n]$ and $\tilde{x}_{Err}[n]$:

$$\tilde{x}_{Ref}[n]=(x_{Ref}[n-L+1] \ldots x_{Ref}[n-1]x_{Ref}[n])$$

$$\tilde{x}_{Err}[n]=(x_{Err}[n-L+1] \ldots x_{Err}[n-1]x_{Err}[n])$$

Wherein L is the data frame length.

The data frames $\tilde{x}_{Ref}[n]$ and $\tilde{x}_{Err}[n]$ enter into the transfer function estimator 1003, calculating the transfer function $h_{ref_err}[n]$ from the REF MIC to the ERR MIC. The compute mode of the transfer function can adopt the mode of dividing the auto-power spectrum by the cross-power spectrum: making $\tilde{X}_{Ref}[k]$ the frequency-domain form of $\tilde{x}_{Ref}[n]$; $\tilde{X}_{Err}[k]$ the frequency-domain form of $\tilde{x}_{Err}[n]$; $H_{ref_err}[k]$ the frequency-domain form of the transfer function $h_{ref_err}[n]$, thus the calculation formula is:

$$H_{ref_err}[k] = \frac{E(\tilde{X}^*_{Err}[k]\tilde{X}_{Err}[k])}{E(\tilde{X}^*_{Err}[k]\tilde{X}_{Ref}[k])}$$

$$h_{ref_err}[n] = ifft(H_{ref_err}[k])$$

wherein $\tilde{X}^*_{Err}[k]$ is the conjugate of $\tilde{X}_{Err}[k]$. E(.) represents requesting expectation operation, and ifft represents inverse Fourier transform.

The time-domain judgment statistic $r_{ref_err}$ calculated by the judgment statistic calculator 1004 is:

$$r_{ref_err} = \frac{\sum_{n=0}^{M} (h_{ref_err}[n])^2}{\sum_{n=0}^{N} (h_{ref_err}[n])^2}$$

wherein, N is the length of the transfer function and is a natural number. That is, the time-domain judgment statistic $r_{ref_err}$ is the ratio of the quadratic sum of the first M order of the transfer function to the quadratic sum of the whole transfer function. The time-domain judgment statistic $r_{ref_err}$ reflects the time delay characteristic between REF MIC signals to ERR MIC signals, i.e. causality. The smaller the time delay, the larger the $r_{ref_err}$, the closer to the state of being able to produce howling. M is a natural number which is smaller than N. Generally, M is 1, 2 or 3. The judgment threshold varies with the structural change of the earphone and is obtained by statistics. The judgment statistic in Howling state is larger than that in noHowling state. If $r_{ref_err}$ is larger than the threshold, judging as the state able to produce a howling, otherwise judging as the state unable to produce a howling.

That is, the estimated value $h_{ref_err}[n]$ of the transfer function obtained by the transfer function estimator 1003 enters into the judgment statistic calculator 1004, and the judgment statistic calculator 1004 calculates the time-domain judgment statistic $r_{ref_err}$. The time-domain judgment statistic $r_{ref_err}$ enters into the state decider 1005 to judge the current state of the earphone (a state unable to produce howling or a state able to produce howling) and to output it. The state decider 1005 judges the state as a state unable to produce a howling when the time-domain judgment statistic is smaller than the judgment threshold, and judges the state as a state able to produce a howling when the time-domain judgment statistic is larger than the judgment threshold.

In aforesaid embodiment, the state judger 903 judges the state of the ANR earphone according to the time-domain transfer function from the first microphone to the second microphone. In another embodiment of the invention, the state judger 903 also can judge the state of the ANR earphone according to the frequency-domain transfer function from the first microphone to the second microphone, specifically:

a first data cache 1001, for caching digital signals collected by the first microphone 901;

a second data cache 1002, for caching digital signals collected by the second microphone 902;

a transfer function estimator 1003, for calculating the frequency-domain transfer function from the first microphone 901 to the second microphone 902 according to the data in the first data cache 1001 and the second data cache 1002;

a judgment statistic calculator 1004, for obtaining a frequency-domain judgment statistic according to the ratio of modular quadratic sum of the first M orders to modular quadratic sum of the first M+1 to N/2 orders of the frequency-domain transfer function from the first microphone to the second microphone; wherein N is a natural number and N is the length of the frequency-domain transfer function; M is a natural number smaller than N/2;

a state decider 1005, for judging as the state able to produce a howling when the frequency-domain judgment statistic is smaller than the judgment threshold; and judging as the state unable to produce a howling when the frequency-domain judgment statistic is larger than the judgment threshold, wherein the judgment threshold varies with the structural change of the earphone and is obtained by statistics.

Still taking the Hybrid ANR earphone as an example, the first microphone 901 is the REF MIC of the Hybrid ANR earphone, and the second microphone 902 is the ERR MIC of the Hybrid ANR earphone. First the transfer function from the REF MIC to the ERR MIC is calculated. The digital signal $x_{Ref}[n]$ of the REF MIC and the digital signal $x_{Err}[n]$ of the ERR MIC enter into the first data cache 1001 and the second data cache 1002 respectively, forming data frames $\tilde{x}_{Ref}[n]$ and $\tilde{x}_{Err}[n]$:

$$\tilde{x}_{Ref}[n]=(x_{Ref}[n-L+1] \ldots x_{Ref}[n-1]x_{Ref}[n])$$

$$\tilde{x}_{Err}(x_{Err}[n-L+1] \ldots x_{Err}[n-1]x_{Err}[n])$$

Wherein L is the data frame length.

The data frames $\tilde{x}_{Ref}[n]$ and $\tilde{x}_{Err}[n]$ enter into the transfer function estimator 1003, calculating the frequency-domain transfer function $H_{ref_err}[k]$ of the REF MIC to the ERR MIC. The compute mode of the transfer function can adopt the mode of dividing auto-power spectrum by the cross-power spectrum: making $\tilde{X}_{Ref}$ [k] the frequency domain form of $\tilde{x}_{Ref}$ [n]; $\tilde{X}_{Err}$ [k] the frequency domain form of $\tilde{x}_{Err}$[n]; $H_{ref_err}$ [k] the frequency domain form of the transfer function $h_{ref_err}$ [n], thus the calculation formula is:

$$H_{ref_err}[k] = \frac{E(\tilde{X}^*_{Err}[k]\tilde{X}_{Err}[k])}{E(\tilde{X}^*_{Err}[k]\tilde{X}_{Ref}[k])}$$

wherein $\tilde{X}^*_{Err}$[k] is the conjugate of $\tilde{X}_{Err}$ [k]. E(.) represents requesting expectation operation.

The frequency-domain judgment statistic $R_{ref_err}$ calculated by the judgment statistic calculator 1004 is:

$$R_{ref_err} = \frac{\sum_{k=0}^{M} |H_{ref_err}[k]|^2}{\sum_{k=M+1}^{N/2} |H_{ref_err}[k]|^2}$$

wherein, N is the length of the transfer function. That is, the frequency-domain judgment statistic $R_{ref_err}$ is the ratio of the modular quadratic sum of the first M order of the frequency-domain transfer function to the modular quadratic sum of the M+1 to N/2 order of the frequency-domain transfer function. The judgment statistic reflects the low-pass filter property of the transfer function. The larger the $R_{ref_err}$, the better the low-pass filter property, the closer to the state of being unable to produce a howling. The judgment threshold varies with the structural change of the earphone and is obtained by statistics. If the judgment statistic $R_{ref_err}$ is larger than the threshold, judging as the state unable to produce a howling, otherwise judging as the state able to produce a howling.

The estimated value $H_{ref_err}$ [k] of the transfer function obtained by the transfer function estimator 1003 enters into the judgment statistic calculator 1004, and the judgment statistic calculator 1004 calculates the frequency-domain judgment statistic $R_{ref_err}$. The frequency-domain judgment statistic $R_{ref_err}$ enters into the state decider 1005 to judge the current state of the earphone.

In an embodiment of the invention, when the current state of the earphone is noHowling, starting ANR; when the current state of the earphone is Howling, shutting down ANR, thus the howling suppression is achieved.

In summary, the technical scheme of the present invention uses the relation between signals collected by the first microphone which is arranged in a position outside an auditory meatus when an ANR earphone is worn and the second microphone which is arranged in a position inside the auditory meatus when the ANR earphone is worn to judge whether the current state of the ANR earphone is a state unable to produce a howling or a state able to produce a howling, and starts processing to prevent howling production when the current state of the ANR earphone is a state able to produce a howling, which can judge whether or not the ANR earphone is in a state of being able to produce a howling and can perform a howling processing when judging that the ANR earphone is in a state of being able to produce a howling, thus howling production can be prevented when the ANR earphone is in a state of being able to produce a howling. And then it can achieve that the ANR earphone does not produce a howling all the time, and thus can avoid damaging device and reduce users' discomfort.

The foregoing descriptions merely show preferred embodiments of the present invention, and are not intended to limit the protection scope of the present invention. Any modification, equivalent replacement and improvement made within the spirit and principle of the present invention shall fall into the protection scope of the present invention.

The invention claimed is:

1. A howling suppression method applied to an Active Noise Reduction (ANR) earphone before howling occurs, comprising:

collecting signals using a first microphone and then a second microphone, wherein the first microphone is arranged in a position outside an auditory meatus when the ANR earphone is worn, and the second microphone is arranged in a position inside the auditory meatus when the ANR earphone is worn;

generating a transfer function that relates the collected signals from the first and second microphones;

using the transfer function, determining whether a current state of the ANR earphone is a state that is able to produce howling; and suppressing howling when the current state of the ANR earphone is the state able to produce howling.

2. The method according to claim 1, wherein judging the current state of said ANR earphone that is able to produce howling comprises:

judging whether the current state of said ANR earphone is a state unable to produce a howling or a state able to produce a howling according to a time-domain characteristic of the transfer function from the first microphone to the second microphone; or, judging whether the current state of said ANR earphone is a state unable to produce a howling or a state able to produce a howling according to a frequency-domain characteristic of the transfer function from the first microphone to the second microphone.

3. The method according to claim 2, wherein judging whether the current state of said ANR earphone is a state unable to produce a howling or a state able to produce a howling according to a time-domain characteristic of the transfer function from the first microphone to the second microphone comprises:

making a time-domain judgment statistic as the ratio of quadratic sum of the first M orders to quadratic sum of the first N orders of the time-domain transfer function from the first microphone to the second microphone; wherein N is a natural number, and N is the length of said time-domain transfer function; M is a natural number which is smaller than N;

if said time-domain judgment statistic is smaller than a judgment threshold, judging as a state unable to produce a howling; if said time-domain judgment statistic is larger than the judgment threshold, judging as a state able to produce a howling, wherein the judgment threshold varies with structural change of the earphone and is obtained by statistics.

4. The method according to claim 2, wherein judging whether the current state of said ANR earphone is a state unable to produce a howling or a state able to produce a howling according to a frequency-domain characteristic of the transfer function from the first microphone to the second microphone comprises:

making a frequency-domain judgment statistic as the ratio of modular quadratic sum of the first M orders to modular quadratic sum of the first M+1 to N/2 orders of the frequency-domain transfer function from the first microphone to the second microphone; N is a natural number, and N is the length of said frequency-domain transfer function; M is a natural number which is smaller than N/2;

if said frequency-domain judgment statistic is smaller than the judgment threshold, judging as a state able to produce a howling; if said frequency-domain judgment statistic is larger than the judgment threshold, judging as a state unable to produce a howling, wherein, the judgment threshold varies with structural change of the earphone and is obtained by statistics.

5. The method according to claim 1, wherein processing for preventing howling production comprises: amending ANR parameters or shutting down ANR circuits.

6. The method according to claim 1, wherein, when said ANR earphone is a Feed Forward ANR earphone, said first microphone is a REF MIC demanded to realize the Feed Forward ANR;

when said ANR earphone is a Feed Back ANR earphone, said second microphone is an ERR MIC demanded to realize the Feed Back ANR;

when said ANR earphone is a Hybrid ANR earphone, said first microphone is a REF MIC demanded to realize the Feed Forward ANR, and said second microphone is an ERR MIC demanded to realize the Feed Back ANR.

7. A howling suppression device applied to an Active Noise Reduction (ANR) earphone before howling occurs, comprising:

a first microphone configured to fit outside an auditory meatus when the ANR earphone is worn;

a second microphone configured to fit inside the auditory meatus when the ANR earphone is worn;

a state judger configured to generate a transfer function that relates signals firstly collected from the first microphone and then collected from the second microphone and, based on the transfer function, judging whether a current state of the ANR earphone is able to produce howling;

a howling processor for preventing howling when the current state of said the ANR earphone outputted by said state judger is able to produce howling.

8. The device according to claim 7, wherein said state judger comprises:

a first data cache, for caching digital signals collected by the first microphone;

a second data cache, for caching digital signals collected by the second microphone;

a transfer function estimator, for obtaining a time-domain transfer function from the first microphone to the second microphone according to data in the first data cache and the second data cache;

a judgment statistic calculator, for obtaining a time-domain judgment statistic according to the ratio of quadratic sum of the first M orders to quadratic sum of the first N orders of the time-domain transfer function from the first microphone to the second microphone; wherein, N is a natural number and N is the length of said time-domain transfer function; M is a natural number which is smaller than N; and a state decider, for judging as a state unable to produce a howling when said time-domain judgment statistic is smaller than a judgment threshold; and judging as a state able to produce a howling when said time-domain judgment statistic is larger than the judgment threshold, wherein the judgment threshold varies with structural change of the earphone and is obtained by statistics.

9. The device according to claim 7, wherein said state judger comprises:

a first data cache, for caching digital signals collected by the first microphone;

a second data cache, for caching digital signals collected by the second microphone;

a transfer function estimator, for obtaining a frequency-domain transfer function from the first microphone to the second microphone according to data in the first data cache and the second data cache;

a judgment statistic calculator, for obtaining a frequency-domain judgment statistic according to the ratio of modular quadratic sum of the first M orders to modular quadratic sum of the first M+1 to N/2 orders of the frequency-domain transfer function from the first microphone to the second microphone; wherein N is a natural number and is the length of said frequency-domain transfer function; M is a natural number which is smaller than N/2; and a state decider, for judging as a state able to produce a howling when said frequency-domain judgment statistic is smaller than the judgment threshold; and judging as a state unable to produce a howling when said frequency-domain judgment statistic is larger than the judgment threshold, wherein the judgment threshold varies with the structural change of the earphone and is obtained by statistics.

10. The device according to claim 7, wherein when said ANR earphone is a Feed Forward ANR earphone, said first microphone is a REF MIC demanded to realize the Feed Forward ANR;

when said ANR earphone is a Feed Back ANR earphone, said second microphone is an ERR MIC demanded to realize the Feed Back ANR; and when said ANR earphone is a Hybrid ANR earphone, said first microphone is a REF MIC demanded to realize the Feed Forward ANR, and said second microphone is an ERR MIC demanded to realize the Feed Back ANR.

* * * * *